US007480993B2

(12) United States Patent
Takashima et al.

(10) Patent No.: US 7,480,993 B2
(45) Date of Patent: Jan. 27, 2009

(54) METHOD OF MANUFACTURING A NOZZLE PLATE

(75) Inventors: Nagamitsu Takashima, Nagano (JP); Makoto Fujita, Nagano (JP); Tsuyoshi Kitahara, Nagano (JP); Takahiro Katakura, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 9 days.

(21) Appl. No.: 11/374,143

(22) Filed: Mar. 14, 2006

(65) Prior Publication Data

US 2006/0191138 A1 Aug. 31, 2006

Related U.S. Application Data

(62) Division of application No. 10/471,339, filed as application No. PCT/JP02/13208 on Dec. 18, 2002, now abandoned.

(30) Foreign Application Priority Data

Dec. 20, 2001 (JP) ..... P2001-387013

(51) Int. Cl.
*B21D 53/76* (2006.01)
*B21D 28/00* (2006.01)

(52) U.S. Cl. ..... 29/890.1; 29/424; 29/432; 72/340

(58) Field of Classification Search ..... 29/890.1, 29/417, 412, 432, 424, 522.1, 523, DIG. 19; 347/47, 67, 68, 92, 44, 149, 66; 72/379.2, 72/356, 325–327, 358, 377, 340; 451/57, 451/58

See application file for complete search history.

(56) References Cited

U.S. PATENT DOCUMENTS

| | | | | |
|---|---|---|---|---|
| 2,781,849 | A * | 2/1957 | Bladergroen et al. | 72/327 |
| 4,368,476 | A | 1/1983 | Uehara et al. | |
| 4,425,777 | A * | 1/1984 | Jeglinski | 72/325 |
| 4,544,327 | A * | 10/1985 | Kato | 416/241 B |
| 4,574,445 | A * | 3/1986 | Bentin et al. | 29/890.1 |
| 5,361,478 | A * | 11/1994 | Grossberndt et al. | 29/432.2 |
| 5,701,148 | A | 12/1997 | Moynihan et al. | |
| 5,724,850 | A * | 3/1998 | Yamagiwa et al. | 72/370.02 |
| 5,752,316 | A * | 5/1998 | Takagi et al. | 29/888.4 |
| 6,341,836 | B1 | 1/2002 | Koike et al. | |
| 6,409,308 | B1 | 6/2002 | Maher et al. | |

FOREIGN PATENT DOCUMENTS

| | | | |
|---|---|---|---|
| JP | 1-26837 | B2 | 5/1989 |
| JP | 6-524 | U | 1/1994 |
| JP | 6-29724 | U | 4/1994 |
| JP | 11-101154 | * | 4/1999 |
| JP | 2000-289211 | A | 10/2000 |
| JP | 2001-18398 | A | 1/2001 |

* cited by examiner

*Primary Examiner*—Peter Dungba Vo
*Assistant Examiner*—Tai Nguyen
(74) *Attorney, Agent, or Firm*—Sughrue Mion, PLLC

(57) ABSTRACT

A nozzle plate of the invention has nozzle opening including a taper part 2 for guiding ink in a pressure generation chamber and a straight pore part 3 formed contiguous with the taper part.

5 Claims, 2 Drawing Sheets

METHOD OF MANUFACTURING A NOZZLE PLATE

U.S. RELATED APPLICATION DATA

This is a divisional of Application No. 10/471,339 filed Sep. 10, 2003 now abandoned, which is a National Stage entry of PCT/JP02/13208 filed on Dec. 18, 2002, which claims priority from JP 2001-387013 filed on Dec. 20, 2001. The entire disclosures of the prior applications are hereby incorporated by reference.

TECHNICAL FIELD

This invention relates to a nozzle plate used with a liquid droplet ejecting head such as an ink jet record head for ejecting ink pressurized in pressure generation chambers to a record medium of a target as droplets such as ink droplets suited for print, for example, and more particularly to the structure of a nozzle opening, a method of manufacturing the nozzle opening and a punch suited for forming the nozzle opening.

BACKGROUND ART

A liquid droplet ejecting head used with a liquid droplet ejecting apparatus, for example, an ink jet record head in a print field has nozzle openings communicating with pressure generation chambers. The pressure generation chamber receives energy of piezoelectric vibrators or heating elements and pressurizing liquid for recording so that the liquid for recording is ejected as droplets. Each nozzle opening has a taper part for efficiently converting ink pressurized in the pressure generation chamber into a liquid flow and a straight part for ejecting an ink droplet in a predetermined direction. Particularly, the nozzle opening affecting the droplet ejection performance needs to not Particularly, the nozzle opening affecting the droplet ejection performances needs to not only have an extremely minute opening diameter of several ten μm, but also be uniform in the same nozzle plate to ensure the droplet amount and ejection speed.

Such a nozzle opening of a nozzle plate is formed by a method of forming a through hole including a taper part by a punch from one face of press-workable metal, for example, a thin plate of stainless steel and lapping and removing burrs on an opposite face.

As disclosed in JP-B-1-26837, a method of forming a concave part on one face and a convex part on an opposite face by a punch and removing the convex part by grinding is adopted.

In such a punch, considering workability, the area which becomes a pore part of a nozzle opening is formed as a forward taper part with the tip side a little tapering and thus a pore part B of a nozzle opening A is also formed like a forward taper having an angle θ1 as shown in FIG. 4.

That is, to form a concave part on one face and a convex part on an opposite face by a punch tapering on the tip side or punch a through hole and remove a convex part by grinding or conduct a lapping step for removing burrs in the through hole. Since the concave part or the through hole has a taper angle of about two degrees, if the grinding amount changes on the order of 10 μm, hole diameter ϕ at the nozzle tip (usually, 30 μm) changes 0.7 μm, largely affecting the ejection characteristic of an ink droplet, particularly the ejection speed; this is a problem.

JP-UM-A-6-29724 discloses forming of a through hole by a punch formed with a reverse taper part on the tip side, but the invention described in the gazette is intended for decreasing the contact pressure with a workpiece in the punching step of the punch and is not intended for straightening the shape of a through hole. That is, an extremely large reverse taper angle is set so as not to come in contact with the punch as the through hole of the workpiece becomes elastically deformed during punching and after punching.

It is therefore an object of the invention to provide a nozzle plate suitable for a liquid droplet ejecting head for a liquid droplet ejecting apparatus including nozzle openings each having a pore part having a diameter of a stipulated size regardless of the grinding amount after punching.

It is another object of the invention to propose a method of manufacturing the nozzle plate.

It is still another object of the invention to provide a punch suited for manufacturing the nozzle plate.

DISCLOSURE OF THE INVENTION

According to the invention, there is provided a nozzle plate for a liquid droplet ejecting head which includes nozzle openings each including a taper part for guiding liquid in a pressure generation chamber and a pore part being formed contiguous with the taper part, wherein the pore part is formed in a straight shape.

Since the pore part is formed in a straight shape, the tip diameters of the pore parts of the nozzle openings can be made constant regardless of the grinding amount in the grinding step after punching.

BEST MODE FOR CARRYING OUT THE INVENTION

Figure 1:
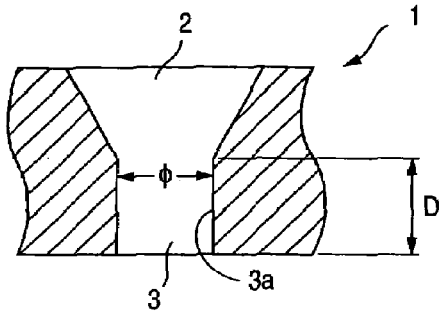
FIG. 1 is a drawing to show one embodiment of a nozzle plate of a liquid droplet ejecting apparatus of the invention with the proximity of a nozzle opening shown on an enlarged scale.

FIG. 1 shows one embodiment of a nozzle plate of the invention. Each nozzle opening of a nozzle plate 1 includes a taper part 2 for guiding liquid pressurized in a pressure generation chamber and a pore part 3 for controlling the ejection amount and the ejection direction of a liquid droplet. Since the pore part 3 is formed as a through hole including a wall 3*a* perpendicular to the surface of the nozzle plate, diameter ϕ of an ejection port of the nozzle opening becomes constant regardless of the thickness roughly as much as depth D of the pore part 3 at the maximum.

Figure 2:
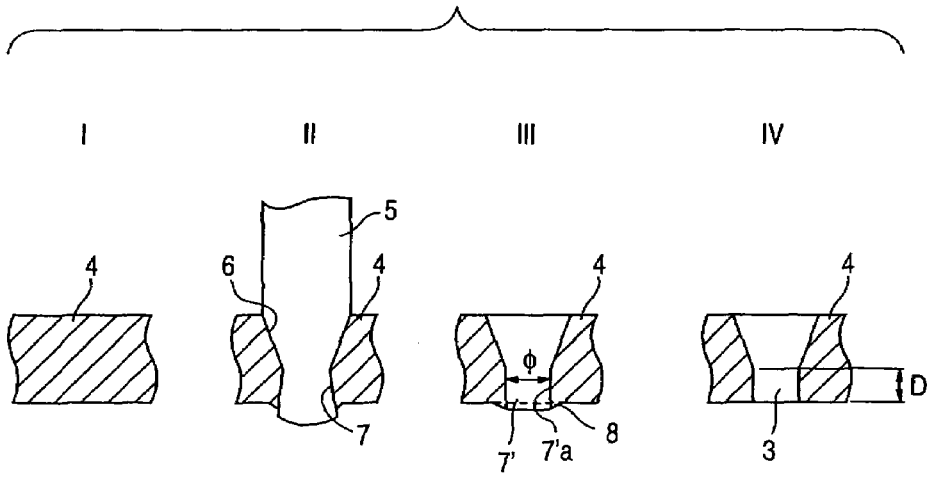
FIGS. 2 (I) to (IV) are drawings to show a method of manufacturing the nozzle plate.

FIG. 2 shows one embodiment of a method of manufacturing the nozzle plate. If an elastic plate material which becomes a nozzle plate formation material 4, for example, a plate material of stainless steel is punched by a punch 5, a through hole made up of a forward taper part 6 of large diameter in an entry direction and a reverse taper part 7 of small diameter contiguous with the forward taper part is formed.

Figure 3A:
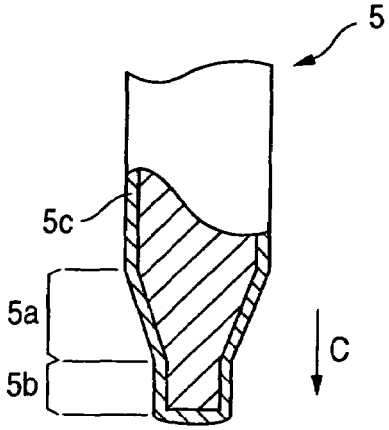
FIGS. 3 (*a*) and (*b*) are a sectional view to show one embodiment of a punch used for working nozzle plate and a schematic drawing to show a reverse taper part of the punch tip.
Figure 3B:
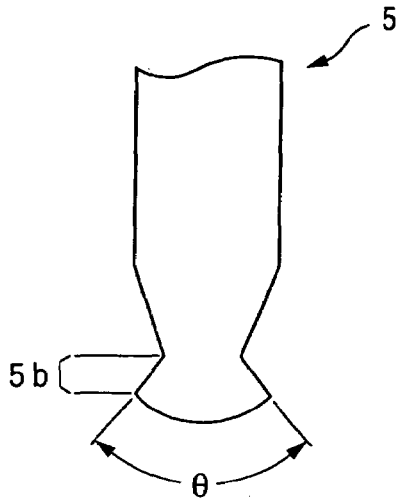
Figure 4:
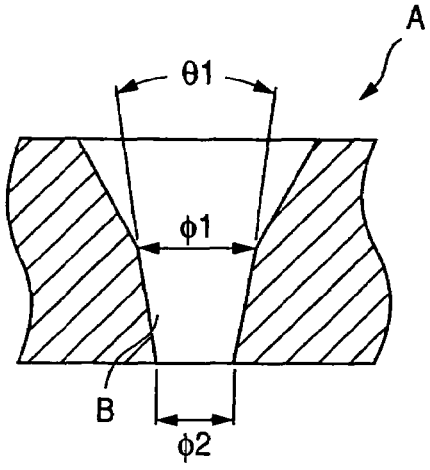
FIG. 4 is a drawing to show one example of a nozzle plate for an ink jet record apparatus as a liquid droplet ejecting apparatus in a related art with the proximity of a nozzle opening shown on an enlarged scale.

The punch 5 is formed with a forward taper part 5*a* for forming the taper part 2 of the nozzle opening on the main body side and a reverse taper part 5*b* spread in the opposite direction from the forward taper part 5*a* on the tip side (in the figure, the lower side) in an entry direction C so as be contiguous with the forward taper part, as shown in FIG. 3 (*a*). As shown in FIG. 3 (*b*), preferably, taper angle θ of the reverse taper part 5*b* is in the range of $$0<\theta\leqq 1.0$$

relative to the entry direction C of the punch 5 although it slightly varies depending on the elasticity of the nozzle plate formation material. That is, if the reverse taper angle θ is smaller than 0 degrees, the pore part 3 tapers and if the reverse taper angle θ becomes larger than 1.0 degree, it becomes difficult to pull out the punch 5. In the figure, numeral 5*c* denotes a titanium nitride layer formed on the surface of the punch 5.

If the punch 5 is pulled out after the through hole is formed, the reverse taper part 7 of small diameter corresponding to the punch 5 becomes a through part 7' having a straight shape because of the elasticity of the nozzle plate formation material 4, namely, a wall 7*a*' perpendicular to the nozzle plate formation material 4 (II). Next, if a burr 8 at the tip of the through part 7' is removed by lapping, the pore part 3 is made (III, IV).

The through part 7' having the perpendicular wall 7*a* has the same diameter ϕ in the depth direction, so that the same diameter ϕ is maintained as much as possible against fluctuation of the depth D of the pore part 3 caused by some fluctuation of the grinding amount and thus the tip diameters of the nozzle openings become the same.

Table 1 lists the relationships among the grinding amount, the diameter of the pore part 3 of the nozzle opening, and droplet ejection speed with respect to the taper angle of the pore part 3. As obvious from the table, in the invention, if the grinding amount fluctuates on the order of 10 μm, change in the droplet ejection speed is 0.2 m/s at the most, but if formation as a forward taper on the order of two degrees in the related art is conducted, change in the droplet ejection speed becomes about five times as 1.0 m/s.

TABLE 1

| Taper angle | Grinding amount | Nozzle diameter | Droplet ejection speed |
|---|---|---|---|
| Reverse taper of 1° | 10 μm | ϕ30.0 μm | 10.0 m/s |
| (present invention) | 20 μm | ϕ29.9 μm | 10.2 m/s |
| Taper of 0° | 10 μm | ϕ30.0 μm | 10.0 m/s |
| (present invention) | 20 μm | ϕ30.1 μm | 9.8 m/s |
| Forward taper of 2° | 10 μm | ϕ30.0 μm | 10.0 m/s |
| (related art) | 20 μm | ϕ30.7 μm | 11.0 m/s |

INDUSTRIAL APPLICABILITY

As described above, in the nozzle plate of the present invention, the tip diameters of the nozzle openings become constant regardless of the grinding amount of the nozzle plate, and therefore the droplet ejection speed can be made constant as much as possible and a droplet can be deposited on a predetermined position of a target with high accuracy.

Accordingly, in a textile printing field, a dye can be applied to a cloth of a target and in a printed board manufacturing field, a liquid conductive material, adhesive, film forming agent can be applied to a substrate corresponding to a circuit pattern.

In addition, the invention can be applied to a liquid droplet ejecting head for applying or spraying color agent of a color filter of a liquid crystal display, etc., or conductive paste of an electrode forming agent of an organic electroluminescent display or a face light emitting display and a field of a liquid droplet ejecting head of a precision pipet for accurately supplying and dropping a predetermined amount of a sample or a reagent in biochip, chemical and biochemical fields.

The invention claimed is:

1. A method of manufacturing a nozzle plate for a liquid droplet ejecting head, comprising the steps of:

punching a nozzle plate formation material by a punch including a forward taper part of large diameter and a reverse taper part of small diameter contiguous with the forward taper part; therefore forming a through hole having variable diameters in said nozzle plate material;

grinding an area which becomes a nozzle opening tip of the through hole formed as the punch is pulled out, wherein the area is opposed to a face to which the punch is pressed in the punching process, and the area is ground after passes through the nozzle plate formation.

2. The method of manufacturing the nozzle plate for the liquid droplet ejecting head as set forth in claim 1, wherein a taper angle θ of the area shaped in the reverse taper is $$0<\theta\leqq 1.0.$$

3. A method of manufacturing a nozzle plate for a liquid droplet ejecting head, comprising:

providing a nozzle plate material and a punch, the punch comprising a distal end and a punch end, the punch end having a first tapered portion which narrows from a first diameter to an intermediate diameter and that transitions to a second tapered portion which expands from the intermediate diameter to a second diameter, the second diameter being greater than the first diameter;

punching the nozzle plate material with the punch in a punching direction; therefore forming a through hole having variable diameters in the nozzle plate material; and grinding an area opposite the punching direction, which becomes a nozzle opening tip of a through hole formed as the punch is pulled out after the punch passes through the nozzle plate material.

4. The method of manufacturing the nozzle plate for the liquid droplet ejecting head as set forth in claim 3, wherein a taper angle θ of the second tapered portion is $$0<\theta\leqq 1.0 \text{ degrees.}$$

5. The method of manufacturing the nozzle plate for the liquid droplet ejection head as set forth in claim 3, wherein the first tapered portion is arranged in a downstream side of the second tapered portion in the punching direction.

* * * * *